United States Patent [19]

Kamogawa et al.

[11] 4,297,562

[45] Oct. 27, 1981

[54] HEAT ROLLER TYPE FIXING APPARATUS

[75] Inventors: Nin-ichi Kamogawa, Tokyo; Takashi Ito, Hachioji, both of Japan

[73] Assignee: Konishiroku Photo Industry Co., Ltd., Tokyo, Japan

[21] Appl. No.: 101,910

[22] Filed: Dec. 10, 1979

[30] Foreign Application Priority Data

Dec. 15, 1978 [JP] Japan ..... 53-156161

[51] Int. Cl.[3] ..... H05B 1/02

[52] U.S. Cl. ..... 219/216; 219/388; 219/471; 219/553; 355/14 E; 432/60

[58] Field of Search ..... 219/216, 220, 354, 411, 219/469, 470, 471, 388, 553, 530; 355/111, 14 E, 15, 380; 432/60, 228; 100/93 RP

[56] References Cited

U.S. PATENT DOCUMENTS

| | | | |
|---|---|---|---|
| 3,196,766 | 7/1965 | Hansen et al. | 355/15 |
| 3,461,275 | 8/1969 | Poole | 219/469 X |
| 3,582,615 | 6/1971 | Schippers et al. | 219/471 |
| 3,725,635 | 4/1973 | Seil et al. | 219/216 |
| 3,825,725 | 7/1974 | Leitner et al. | 219/469 X |
| 4,109,135 | 8/1978 | Minden | 219/216 |

*Primary Examiner*—Volodymyr Y. Mayewsky
*Attorney, Agent, or Firm*—James E. Nilles

[57] ABSTRACT

A heat roller type fixing apparatus having a heat roller accommodating a heating element and adapted for fixing a toner image to a copying paper, a temperature sensing element for sensing the temperature of the heat roller surface and a control circuit adapted to cooperate with the temperature sensing element in controlling the heat roller surface temperature. The heat roller and the heating element are so arranged, in the temperature rising period from the start of the power supply to the heating element till the heat roller surface is heated up to a set temperature, that the highest roller surface temperature is observed at portions of the heat roller between the center and both axial ends of the roller, and that the temperature sensing element is disposed on or in the close proximity of one of the portions of the highest roller surface temperature. The temperature sensing element is a thermocouple stretched along the portion of the heat roller of the highest temperature in the axial direction of the roller and slightly apart from the surface of the roller.

3 Claims, 6 Drawing Figures

ROLLER SURFACE TEMPERATURE DISTRIBUTION

HEAT ROLLER TYPE FIXING APPARATUS

BACKGROUND OF THE INVENTION

The present invention relates to a heat roller type fixing apparatus which comprising a heating element such as an infrared lamp having a temperature distribution property so arranged that the highest temperature is obtained at portions of the heat roller between the central portion and both axial portions than at other portions when the heating element is energized, that is, in the rising time of the element and, a temperature sensing element positioned so coming into contact with or closing to the surface of the heat roller at the highest portion thereof.

Various types of apparatus have been used for heat fixing in electro-photographic copying machines, e.g. direct-heating type apparatus, oven type apparatus, roller type apparatus and so forth.

Among these known methods, the roller type fixing apparatus is superior in that it does not cause fire even in case of jamming with copying paper. A typical example of this type of apparatus is disclosed in the specification of U.S. Pat. No. 3,196,766.

This type of fixing apparatus, however, involves a problem concerning the rising time of fixing. Namely, this type of apparatus requires a longer period of time until the roller surface is heated up to a predetermined temperature for heat fixing a toner image onto the copying paper after the start of the electric power supply to the heating element, as compared with other types of apparatus such as, for example, direct heating type. Various studies have been made to shorten the rising time of fixing, in order to obviate the above-mentioned problem in the roller type fixing apparatus. However, even the improved roller type fixing apparatus requires a rising time which is as long as 2 to 5 minutes.

These problems are described by using a conventional roller type fixing apparatus as shown in FIGS. 1 to 3, in detail. FIG. 1 is a perspective view of a heat roller type fixing apparatus, FIG. 2 is a sectional view taken along the line A—A of FIG. 1 and FIG. 3 shows a temperature curve of the heat roller surface thereof. In Figures, a reference numeral 1 denotes a heat or upper roller which is usually an aluminum roller having a diameter of 40 mm and a wall thickness of 4 to 5 mm and coated with a tetrafluoroethylene of 40 to 80$\mu$ thick. An infrared ray lamp or heating element 2 disposed at the inside of the roller and adapted for heating the roller, in which the lamp has a capacity, for example, of 800 W and the filament is elongated along in the direction of length of the lamp so as to be obtained uniformly temperature distribution when the lamp is energized. A lower roller 3 is adapted to cooperate with the upper roller 2 in clampling and driving the copying paper therebetween. The lower roller 3 usually is made of silicon rubber or coated with the same.

A reference numeral 4 denotes bearings for rotatably supporting the rollers, while gears for rotatively driving the upper and lower rollers are designated at reference numerals 5 and 6. A reference numeral 7 denotes a temperature sensing element constituted by a thermocouple such as of chromel-alumel or a temperature-sensitive resistance element such as thermister, which element is disposed at a central portion of the upper roller. A cover 8 is adapted to protect the temperature sensing element against wind.

In order to shorten the rising time of the fixing device, various measures can be adopted such as to increase the capacity of the infrared ray lamp 2 or to reduce the heat capacity of the upper roller 1. However, if the rising period or time is reduced to 1 minute or so by adopting the aforementioned measures, the overshoot of the temperature, which will be described latter, is inconveniently increased, and the temperature of the upper roller is lowered considerably at both axial ends of the roller as compared with the central portion of the same, resulting in an uneven temperature distribution of the roller and difficulty in the temperature control.

The term "overshoot" of temperature in this specification is used to mean a phenomenon in which, referring to FIG. 3, the roller surface temperature which starts to rise concurrently with the start of the power supply to the lamp 2 in the roller 1, is increased to the level of point B beyond the aimed or set temperature A.

When the temperature sensing element or heat sensitive element 7 is held in contact with the central portion of the upper roller surface, the temperature sensing element delivers a control signal when the roller surface temperature reaches the level A to actuate the control circuit thereby to cut the power supply to the lamp 2. The overshoot or the increase of the temperature to the level B is unavoidable even by this cutting of the power supply to the lamp 2.

This overshoot of the temperature rise is attributable to the temperature gradient existing across the thickness of the upper roller 1, i.e. between the inner surface of the upper roller 1 facing the lamp 2 and the outer surface of the same. Namely, a considerably large amount of heat has been accumulated in the upper roller 1 by the time when the temperature sensing element acts to cut the power supply to the lamp 2 upon detect of the heat roller surface, so that the roll surface temperature is increased even after the cutting of electric power supply. This phenomenon becomes more remarkable as the heat capacity of the lamp 2 is increased.

A larger overshoot will be caused if the temperature sensing element is kept out of contact with the roller, even if the temperature sensing element is set to produce a control signal at a temperature lower than an aimed temperature which is, for example, 180° C. to set the roller surface temperature at the aimed temperature, i.e. 180° C.

Next, the reason why the surface temperature of both ends of the roller 1 is specifically low will be described hereinunder with reference to FIG. 2 showing the roller in section. Firstly, it is to be pointed out that the light-emitting portion of the infrared ray lamp is not extended to the hearing portions 12 of both axial ends. Secondly, the bearing portions 12 themselves have considerably large thermal capacity and are contacted by the bearing 4 and the gear 5 which in turn are thermally coupled to other gears and panels. The phenomenon that the temperature of the upper roller 1 is specifically low at both axial ends as compared with the temperature of the central portion thereof is remarkable particularly in the fixing device which is set to shorten the rising time, partly because of the poor heat conductivity in the axial direction of the upper roller 1 attributable to the thinning of the wall of the latter, and partly because of the fixing device is put into use before the heat is sufficiently distributed to the ends of the roller 1 with the bearing 4 and gear 5 still in cold state, due to the shortened rising time.

Generally speaking, on the one hand, a low fixing temperature causes a fixing under (or insufficient fixing), which is a phenomenon to cause an easy separation of the toner image from the copying paper. On the other hand, a too high fixing temperature causes an offset phenomenon, i.e. a phenomenon in which a part of the toner image is separated from the copying paper and welded to the roller and then transferred to another portion of the copying paper.

The overshoot of the temperature and the unbalance of the temperature distribution on the heat roller surface, if it is not improved, will be caused to inconvenient problems in practice, even if the fixing apparatus which is set to shorten the rising time.

SUMMARY OF THE INVENTION

It is, therefore, an object of the invention to provide a heat roller type fixing apparatus capable of performing a fixing by a precise temperature control and with shortened rising time.

The above and other objects, as well as advantageous features of the invention will become more clear from the following description of the preferred embodiment taken in conjunction with the accompanying drawings.

DETAILED DESCRIPTION OF THE PREFERRED EMBODIMEMT

At first, the inventors have found that it is capable of shorten the rising time by changing the construction or arrangement of the elements of the conventional apparatus described above, for example, to thickness of 2.7 mm of the roller wall and to capacity of 1,300 W of the infrared ray lamp, respectively. Also, the infrared lamp is so designed that a higher temperature is obtained at portions of the upper roller between the central portion and both axial end portions than at other portions when the lamp is energized, that is, in the rising time in order that a uniform distribution of the infrared ray may be obtained on the roller surface. By such a modification, the rising time required for heating the roller surface from the room temperature (18° C.) up to 180° C. is shortened to 1 minute.

In this case, however, an overshoot of temperature which is as high as 23° C. was observed at the central portion of the roller, even by keeping the temperature sensing element such as chromel-alumel thermo-couple and so forth in contact with the roller surface. Needless to say, a larger overshoot of temperature will be observed at the portions of the maximum temperature. Also, a larger overshoot which approximates 40° C. was observed when the temperature sensing element was placed 1 mm above the roller surface.

Then the present inventors have found, as a result of an intense study, that the above-described problem of the prior art can be overcome by providing a roller type fixing apparatus having the following features.

According to the invention, there is provided a heat roller type fixing apparatus having a roller accommodating a heater and adapted for fixing a toner image constituted by a thermoplastic resin and a carbon black mainly, to a copying paper, a temperature sensing element for sensing the temperature of the roller and a control circuit for controlling the roller surface temperature in cooperation with the temperature sensing element, wherein the arrangement is such that, in the temperature rising time or period until the roller surface is heated to a set temperature after the start of the power supply to the heater, the highest temperature is established at portions between the central portion of the roller and both axial end portions of the same, and wherein the temperature sensing element for the control purpose is disposed at or in the close proximity of the portion of the highest temperature of the roller, substantially.

Figure 1:
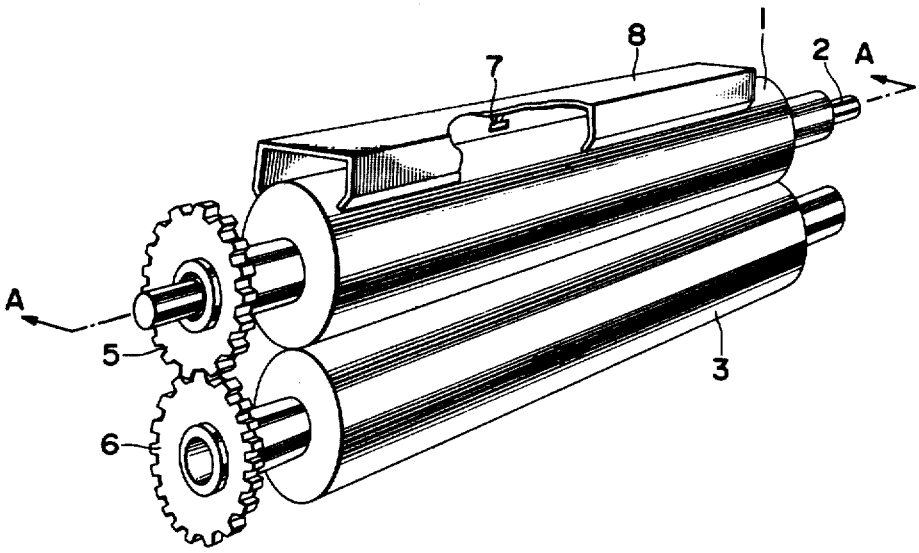
FIG. 1 PRIOR ART
FIG. 1 is a perspective view of a heat roller type fixing apparatus of the prior art.
Figure 2:
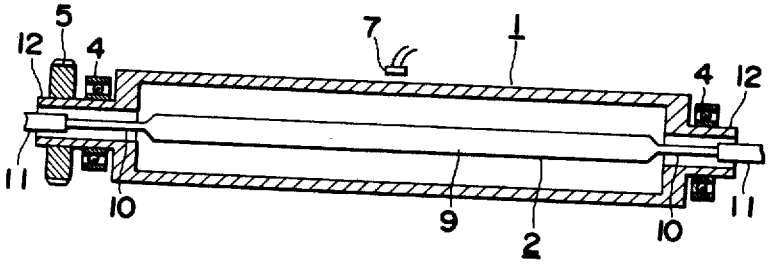
FIG. 2 PRIOR ART
FIG. 2 is a sectional view of the portion of the prior art apparatus of FIG. 1 and taken along the line A—A of FIG. 1.
Figure 3:
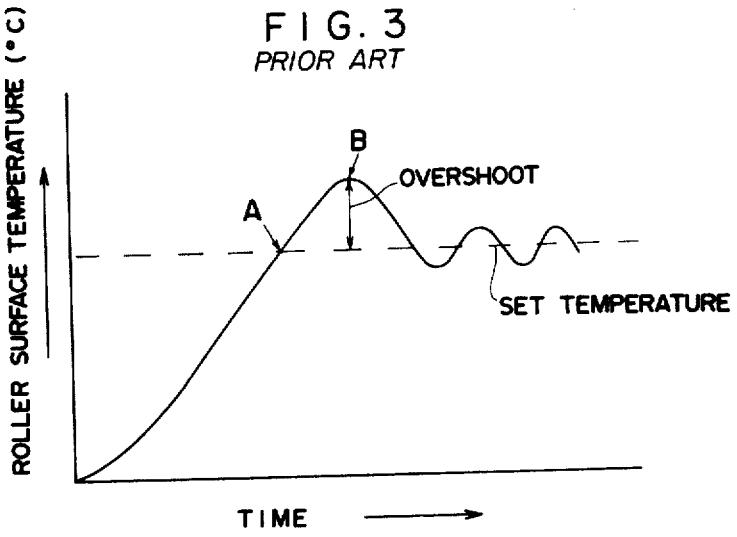
FIG. 3 PRIOR ART
FIG. 3 shows a temperature curve of the surface of the prior art heat roller of FIG. 1.
Figure 4:
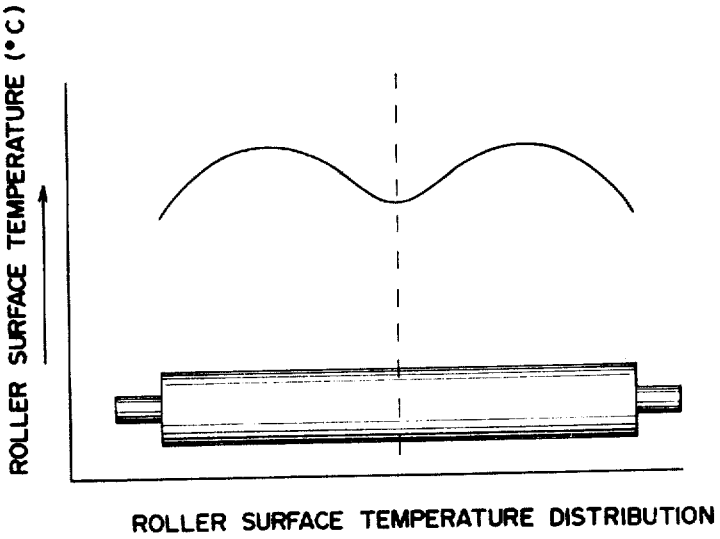
FIG. 4 shows a temperature distribution curve along the roller surface of a heat roller type fixing apparatus of the invention as observed during the rising time.

More specifically, according to the invention, the light distribution of the infrared ray lamp is so designed in relation to the roller that the roller exhibits higher temperature at portions thereof between the central portion and both axial end portions than at other portions as shown in FIG. 4, during rising of the roller surface temperature. According to the invention, a temperature sensing element is disposed at the portion of the highest temperature of the roller.

Figure 5:
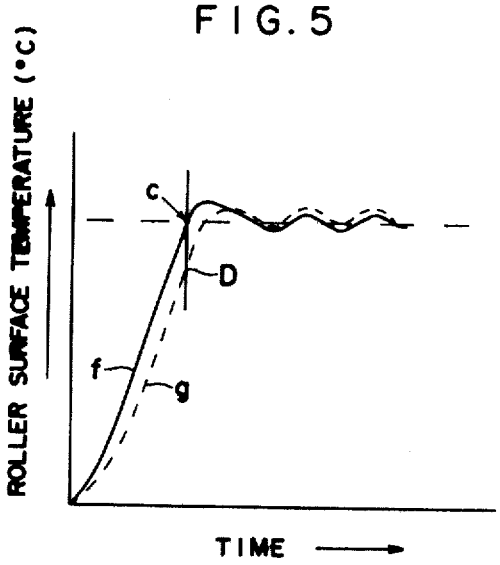
FIG. 5 shows a temperature curve of the heat roller surface of the heat roller type fixing apparatus in accordance with the invention.
Figure 6:
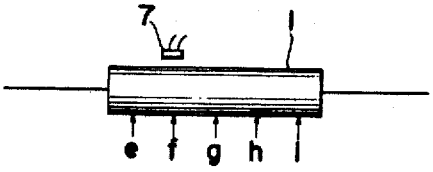
FIG. 6 is a front elevational view of the heat roller and an associated temperature sensing element of the heat roller type fixing apparatus of the present invention.

The heat roller type fixing apparatus having the described construction can suppress the overshoot of roller surface temperature in quite an effective manner as shown in FIG. 5. More specifically, referring to FIG. 6, the desnity of the infrared ray is higher at a point f than at a point g on the roller surface. Also, the escape of the heat from the point f is not so large as that from a point e. Therefore, the roller surface temperature reaches the set level earlier at the point f as well as at the point h than at other portion. As the roller surface temperature at the point f reaches the set temperature, the temperature sensing element 7 is actuated to cut the power supply to the infrared ray lamp. Then, the overshoot of the roller surface temperature takes place. However, since the temperature at the point g, as well as at the point e, is still at low level D when the temperature at the point f has reached the level C, the heat is diffused from the point f to the areas around the points g and e, so that the overshoot of the temperature is effectively suppressed. According to the result of measurement conducted by the present inventors, the temperatures at points e, g and i which are still low at the moment of cutting of the power supply are raised to the set temperature in several seconds after the cutting of power supply. Also, it was confirmed that, once this equilibrium of the temperature is achieved, the points e, f, g, h and i exhibit a common tendency in the subsequent continuous copying operation. This is attributable to the fact that, since the initial heat absorption has been finished at the central and both axial end portions of the roller, all portions of the roller is heated up to the level near the maximum temperatures as the roller is heated.

Assuming here that the temperature sensing element is disposed near the central portion of the roller, the set temperature has reached also at axial end portions of the roller when the power supply to the infrared ray lamp is cut by the temperature sensing element which detects the temperature at the central portion of the roller, because the temperature at the central portion of the roller rise comparatively slowly. However, the portions f and h have reached to a temperature higher than that at other portions. Therefore, large overshoot of the temperature is found anywhere on the roller. For this reason, if it is desired to avoid the overshoot of the temperature by using the temperature sensing element disposed at the central portion of the roller, it is necessary to cut the power supply at a comparatively low temperature in the rising period and to make a control for maintaining the set temperature in the steady condition. This requires a double control circuit for controlling the power supply in the rising period and for controlling the power supply in the steady operating condition of the fixing apparatus.

To the contrary, if the temperature sensing element is disposed at the center of the roller in a fixing apparatus having a fast temperature rising speed, an insufficient temperature rise will be observed at both ends of the roller in the rising period, as stated before.

It is also considered to design such that the highest roller surface temperature is obtained at the central portion of the roller and that a small temperature gradient (reduction of temperature) is generated between the central portion and both end portions of the roller, and to dispose the temperature sensing element at the central portion of the roller, i.e. at the portion of the highest temperature so as to cut the power supply to the infrared ray lamp when the set temperature is reached at the central portion of the roller. This arrangement, however, exhibits a large overshoot of the temperature because of small diffusion of heat from the central portion to both axial end portions of the roller.

A preferred embodiment of the invention will be described hereinafter.

A heat roller type fixing apparatus in accordance with the invention is constituted by an upper roller having an outside diameter of 40 mm and a wall thickness of 2.7 mm, and an infrared ray lamp of 1,300 W selected in relation to the roller to provide the highest-/temperature at points f and h on the roller. The apparatus further has a thermocouple which is kept in contact with the roller surface at the point f. This fixing apparatus showed an overshoot of the temperature which is as low as 10° C., while a similar conventional fixing apparatus having a heat sensing element located at the center of the roller showed an overshoot which is as high as 23° C. It will be understood how the invention is effective in suppressing the overshoot of the temperature.

As a modification of the above described embodiment, the temperature sensing element is placed 1 mm apart from the roller surface, and the operation temperature of the element is readjusted to cut the power supply when the roller surface temperature has reached the set temperature. This modification showed a comparatively high overshoot of 22° C. at the central portion of the roller. This overshoot, however, is much smaller than that (40° C.) exhibited by the similar arrangement with the temperature sensing element placed near the central portion of the roller. Thus, according to the invention, the overshoot of temperature is effectively suppressed, even if the temperature sensing element is located apart from the roller surface.

Another embodiment of the invention will be described hereinunder. In this embodiment, the factors such as the outside diameter of the upper roller, wall thickness of the roller, power of the infrared ray lamp and the distribution of the ray on the lamp are identical to those of the first embodiment. However, the position and the constraction of the temperature sensing element are modified as follows. Namely, a chromel-alumel thermocouple of 0.32 mm is used as the temperature sensing element. This thermocouple is disposed or stretched to extend in parallel with the roll axis over the length of 40 mm and 1 mm apart from the roller surface, such that the juncture point between the chromel and alumel contact to the point f of the upper or heat roller. The fixing apparatus of this embodiment showed a small overshoot of 4° C. at the central portion of the roller, as well as at the points f and h of the highest temperature.

This overshoot of 4° C. falls within the range of ripple of the temperature control in the steady condition. Thus, this embodiment is much superior to the first embodiment having a thermocouple merely disposed to place the juncture 1 mm apart from the point f and exhibiting a large overshoot of 22° C. at the center of the roller.

This embodiment is superior also to a modification which has a thermistor placed to confront the point f with 1 mm gap therebetween and extending in parallel with the roll axis over the length of 40 mm as in the case of the above-described embodiment, and which exhibits a large overshoot of 26° C. at the center of the roller.

What is claimed is:

1. In a heat roller type fixing apparatus having a heat roller with an axial center and two axial ends and accommodating a heating element arranged within said heat roller and adapted for fixing a toner image to a copying paper, a temperature sensing element spaced apart from said heat roller and for sensing the temperature of the heat roller surface and a control circuit adapted to cooperate with the temperature sensing element in controlling the heat roller surface temperature, an improvement being that said heating element is an infrared ray heater having a temperature distribution property so arranged that the highest temperature is obtained between said axial center and both said axial ends when said heating element is energized, whereby said roller can suppress the overshoot of roller surface temperature, said heating element providing a predetermined, nonuniform ray density along the axial direction of said roller whereby the energy emitted by said heating element varies axially along said roller, said temperature sensing element being positioned adjacent one of said points of highest temperature.

2. A heat roller type fixing apparatus as set forth in claim 1, wherein said infrared ray heater comprises a lamp that provides a higher density of the infrared ray at portions between said axial center and both of said axial ends.

3. In a heat roller type fixing apparatus having a heat roller with an axial center and two axial ends and accommodating an energizable heating element and adapted for fixing a toner image to a copying paper, a temperature sensing element for sensing the temperature of the heat roller surface and a control circuit adapted to cooperate with the temperature sensing element in controlling the heat roller surface temperature to attain a set, uniform temperature therealong, an improvement being that said heating element comprises an infrared ray lamp providing a predetermined, nonuniform ray density along the axial direction of said roller whereby the energy emitted by said heating element varies axially along said roller, and wherein the greatest ray density is provided at points intermediate said axial center of said roller and each of said axial ends of said roller to thereby provide a temperature distribution property so arranged that the highest temperature is obtained between said axial center and both said axial ends when said heating element is energized, whereby said roller can suppress the overshoot of roller surface temperature and whereby the highest temperature on said roller surface is attained at points intermediate said axial center of said roller surface and each of said axial ends of said roller surface, said temperature sensing elements located adjacent said intermediate roller surface points, and said control circuit being adapted to deenergize said heating element when said intermediate roller surface points reach said set temperature whereby said entire roller surface uniformly attains said set temperature in several seconds after deenergization of said heating element.

* * * * *